United States Patent [19]

Craske

[11] 4,249,469

[45] Feb. 10, 1981

[54] SAFE HAVING COMBINATION LOCKING MECHANISMS

[75] Inventor: William J. Craske, Chigwell, England

[73] Assignee: Crado Devices Limited, Billericay, England

[21] Appl. No.: 916,784

[22] Filed: Jun. 19, 1978

[30] Foreign Application Priority Data

Jun. 20, 1977 [GB] United Kingdom ..... 25767/77

[51] Int. Cl.[3] ..... E05G 1/04

[52] U.S. Cl. ..... 109/59 R; 70/312; 109/50

[58] Field of Search ..... 70/304, 312, 316, 317, 70/318; 109/50–52, 59; 312/238

[56] References Cited

U.S. PATENT DOCUMENTS

| | | | |
|---|---|---|---|
| 874,933 | 12/1907 | Bristow | 312/238 X |
| 1,604,866 | 10/1926 | Wildrick | 70/312 X |
| 3,416,338 | 12/1968 | Gehrie | 70/312 |
| 3,851,507 | 12/1974 | Gehrie | 70/316 |

*Primary Examiner*—David H. Corbin

*Attorney, Agent, or Firm*—Fleit & Jacobson

[57] ABSTRACT

A safe having first and second combination locking mechanisms which can each open the safe irrespective of the combination setting of the other combination locking mechanism, whereby one combination locking mechanism can be operated by a hotel customer and the other combination locking mechanism can be operated by the hotel management in order to provide a high degree of security.

10 Claims, 11 Drawing Figures

SAFE HAVING COMBINATION LOCKING MECHANISMS

This invention relates to safes.

The protection of valuable and semi-valuable items left by hotel guests in their rooms is becoming increasingly important. Hotels already provide safety deposits for property of high value. However, some articles such for example as sentimentally valued items, credit cards and cash are not normally lodged in the safety deposits because they are located away from guests' rooms and are time consuming and inconvenient to get to. The articles are thus often left in the hotel room while the guest is temporarily absent, and they are increasingly becoming the target of petty thieves who obtain duplicate room keys and, by experience, have learnt rapidly to search through guests' luggage and all likely hiding places within hotel rooms.

The provision of a safe in each room would provide a solution to the problem. However, because of the high turnover in room occupants, a conventional safe with a key lock is not suitable. To minimize risk, each safe would have to be provided with a unique key and the administration and secure control of these keys would place an unacceptable burden on the hotel management. Thus, for example, guests might depart with their keys, or thieves posing as guests might make a copy of their key for use at a later date.

The use of a safe with a conventional combination lock in each room also has unacceptable disadvantages. Thus, although the combination could be altered between each room occupancy, the administrative task of doing this would be too great. Also, the central recording of all individual room safe combinations in the hotel would be necessary in case a guest should forget his particular combination number, and this would present an unacceptable security risk, especially to insurance companies.

It is an aim of the present invention to provide a safe having a locking mechanism which is designed to overcome the aforementioned problems.

Accordingly, the present invention provides a safe having first and second combination locking mechanisms which can each open the safe irrespective of the combination setting of the other combination locking mechanism.

It is envisaged that the first combination locking mechanism can be set in any desired combination by the hotel guest. In the event that the hotel guest should forget the particular combination that he has set, then the hotel management can open the safe by opening the second locking mechanism with a combination known only to the hotel management. The hotel guest can chose any combination at random and the hotel management can vary their combination as and when desired so that a high overall security level can be obtained with a low level of inconvenience to both hotel guests and hotel management.

Preferably, the first and second combination locking mechanisms share common lock parts. The common lock parts may include a plurality of combination dials and a gate assembly for each dial, the gate assembly for each dial being operated by a first release slide which is operated by the first combination locking mechanism and by a second release slide which is operated by the second combination locking mechanism.

Each gate assembly may comprise a drive device having a pair of opposed recesses defined by a ring of teeth, a toothed coding disc fitting in each recess, and a coding lock tab for fitting in a slot in each coding disc and for controlling relative movement between the coding discs and the drive device. Preferably, the safe includes a spring housed in a recess in each coding disc and operative to push the lock tabs against the teeth of the drive device for locking the coding discs to the drive device until such time as the lock tabs move radially inwardly in their slots in the coding discs.

Advantageously, the release slides operate a bolt member. The release slides may each have a first tab for fitting in a recess in the bolt member, and a plurality of second tabs which are equal in number to the number of combination dials and which normally rest between the gate assemblies which are free to rotate.

In an alternative construction of safe in accordance with the invention, the first and second combination locking mechanisms are separate locking mechanisms which are separately operated.

Preferably, the safe includes a key-operated lock, the first combination locking mechanism being operable independently of the key-operated lock, and the second combination locking mechanism being operatively associated with the key-operated lock whereby the key-operated lock must be released before the second combination locking mechanism can be operated to unlock the safe. When the safe is one having the release slides, then the safe is preferably such that it is locked with the first combination locking mechanism set in a desired combination by rotating a safe handle one way, and is also such that it can be unlocked by selecting the correct combination set in the first combination locking mechanism and rotating the handle the other way to operate the first release slide, or by selecting the correct combination set in the second combination locking mechanism and unlocking the key-operated lock to allow the handle to be rotated the said first way to operate the second release slide. Access to the second combination locking mechanism is controlled by the key-operated lock. The hotel guests will thus not be able inadvertently to operate the second combination locking mechanism, and the second combination locking mechanism will thus not readily be accessible to thieves. The key-operated lock may be replaced by other types of lock including combination locks if desired. The key-operated or other lock may be effective to secure in position a cover for the second combination locking mechanism.

The combination-setting dials are advantageously set to letter combinations since key words which a guest is unlikely to forget can thus be formed. Obviously, if desired, number combinations or letter and number combinations can be employed. The letters and/or numbers can be provided on combination-setting dials on, for example, separate display portions. Advantageously, the outer surface of the dials is serrated or otherwise roughened to provide a surface which is easily gripped.

Preferably, the safe is one in which sufficient of the first combination locking mechanism in its locked condition can be seen when the safe has been opened by the second combination locking mechanism in order to enable the first combination locking mechanism to be unlocked with the safe open.

The safes of the present invention can be constructed from the materials presently employed for making safes.

The safes can be made in various sizes and it is to be appreciated that their use is not restricted to hotel rooms. Thus, the safes can be used in the home, in holiday homes, in hospitals and in ships. When the safes are to be used in hotel rooms, they will usually be relatively small so as not to occupy a disporportionate amount of space and, in any event, hotel guests do not usually have large amounts of valuables to store in their rooms.

The safes of the present invention are advantageously so constructed and designed as to fit in a corner of a room, for example a hotel room, whereby they can be secured to two walls of the room which are at right angles to each other. The safes can be secured to the walls by bolts or any other desired means.

Preferably, the safes are provided with sloping walls which slope away from the walls of a room when the safes are in position between two vertical walls of the room which are at right angles to each other. With such sloping safe walls, it is difficult to knock or prise the safes off the walls.

Embodiments of the invention will now be described solely by way of example and with reference to the accompanying drawings in which.

Figure 1:
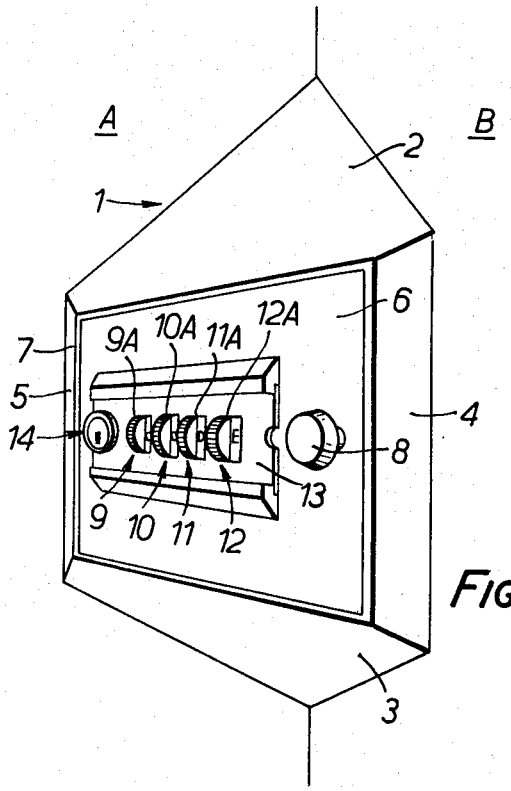
FIG. 1 is a perspective view of a safe in accordance with the invention.

Referring to the drawings, there is shown a safe 1 which has been fitted into a corner of a room by being bolted onto the shown two walls A and B which are at right angles to one another. This position of the safe 1 provides maximum resistance to removal by prising or knocking off. In order to further increase resistance against attempts to knock the safe 1 from its position, the safe 1 is provided with faces 2, 3, 4 and 5 which are angled away from the vertical walls A and B. Blows against the faces 2 and 3 will tend to bounce off, whereas knocks on the faces 4 and 5 tend to push the safe 1 into either wall A or B, rather than away from the walls A and B.

The safe 1 is provided with a lid 6, hinged along one side 7 and secured in the locked position by the bolt, operated by a knob 8. Sliding the knob 8 towards the face 4 locks the lid 6, and sliding the knob 8 in the opposite direction unlocks the lid 6. The knob 8 is shown in FIG. 1 in the locked position.

Movement of the bolt is controlled by a first combination lock mechanism which is assembled beneath the lid 6 and which contains four dials 9, 10, 11 and 12. Each dial 9, 10, 11, 12 contains a setting portion in the form of projecting thumb-disc 9A, 10A, 11A, 12A for enabling the respective dials 9, 10, 11, 12 easily to be rotated.

A metal strip 13 is slideably mounted on the face of the lid 6 and contains four rectangular cut-outs, through which the projecting thumb-discs 9A, 10A, 11A, 12A protrude. With the strip 13 positioned as shown in FIG. 1, a dial letter can be seen on the right side of each thumb-disc 9A, 10A, 11A, 12A, each dial letter being viewed through a rectangular slot in the lid 6 itself. A lock 14 secures the strip 13 in the position shown in FIG. 1.

Figure 2:
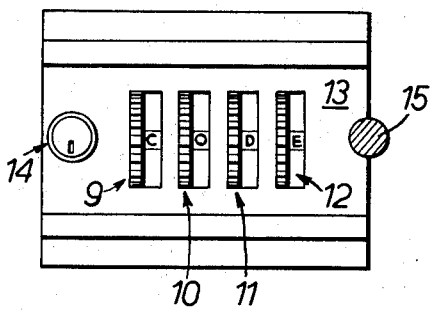
FIG. 2 is a front view of the first combination locking mechanism for the safe shown in FIG. 1.

FIG. 2 shows the combination dials 9, 10, 11 12 in more detail, the stem 15 of the knob 8 being shown in the unlocked position. It can be seen that the strip 13 prevents the stem 15 from moving to the left as shown in FIG. 2. Rotating the combination dials 9, 10, 11, 12 by means of the thumb-discs 9A, 10A, 11A, 12A results in the letters changing in the rectangular slots in the lid 6.

With the knob in the unlocked position, the combination dials 9, 10, 11, 12 are disconnected from the lock mechanism beneath the lid 6, and may be set to show letters in any desired combination. However, the moment the knob 8 is moved to the right to lock the safe 1, the letter combination existing at the moment of movement is fixed into the first combination locking mechanism and cannot again be altered until the box is unlocked once more, even though the combination dials 9, 10, 11, 12 may be rotated into any position in the intervening time. The knob 8 cannot be moved to unlock the safe 1 unless the combination shown at the instant of locking is once more reset.

In the drawings, each combination dial is provided with a complete alphabet of letters, 26 in all, giving 456,976 possible combination settings. Since at any time only one of these will permit the safe 1 to be unlocked, lock security is of a very high order. In FIG. 2, the word CODE has been used to illustrate the correct combination setting.

In every day use, the safe 1 is left unlocked and a hotel guest taking possession of the room can put his small valuables into it. Immediately before locking the safe 1, the guest can think of a suitable four letter code and can then simply turn the combination dials 9, 10, 11, 12 until this is shown. The guest then locks the safe 1, and finally spins the combination dials 9, 10, 11, 12 to produce a random set of letters for view. The safe 1 cannot now be unlocked by anyone other than the hotel management unless the correct chosen combination is reset.

Every safe 1 in the hotel thus will be individually coded by the guest who happens to be occupying its respective room. The codes will be continuously varying and, at any one time, only each guest will have a knowledge of the code last set. Although this would be the ideal situation from the point of view of security, it is unfortunately necessary to enable the management to open a safe at any time. This is because, for example, a guest might forget the combination he set, or he might depart from the hotel leaving the safe 1 locked.

To provide the hotel management with a key lock to enable it to override the guest's lock would reduce the security of the installation unacceptably. If all safes in the hotel had a single master key, the unauthorised removal of their contents would be possible to anyone who could obtain the master key, or make a copy of it. If all the hotel safes had individual management keys, the problem of their control and security could be too great.

Figure 3:
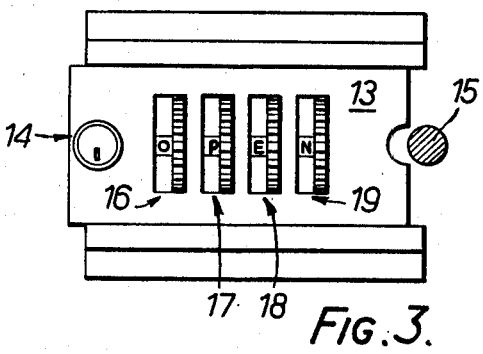
FIG. 3 is a front view of the second combination locking mechanism for the safe shown in FIG. 1.

To overcome this, the safe 1 of the invention is provided with a second combination locking mechanism for use of the hotel management. This second combination locking mechanism comprises a set of combination dials 16, 17, 18, 19 which can only be seen when strip 13 is slid to the left, as shown in FIG. 3. To slide the strip 13 to the left, the lock 14 must be unlocked. The lock 14 need not be of high security manufacture, and indeed can be standard for every safe 1 in the hotel. Its main purpose normally is to secure the strip 13 to prevent hotel guests from seeing the second set of dials 16, 17, 18, 19 which would be confusing for them.

Having uncovered the second set of dials 16, 17, 18, 19 by sliding the strip 13 to the left, a code previously chosen by the hotel management can be set and the safe 1 unlocked. In FIG. 3, the word OPEN has been used to illustrate the hotel management code. Should the hotel management wish to alter its own code, it is now able to do so, movement of the strip 13 to the left having freed the stem 15, and the knob 8 can now also be slid left, beyond its normal unlocked position. This frees the second set of dials 16, 17, 18, 19 from the lock mechanism enabling a new combination code to be chosen. Sliding the knob 8 back to its previous position now re-connects the management discs to the lock mechanism, fixing the newly set code. Finally, the strip 13 is returned to its original position and relocked in position by lock 14, thereby preventing inadvertent or unauthorised alteration to the hotel management setting.

Figure 4:
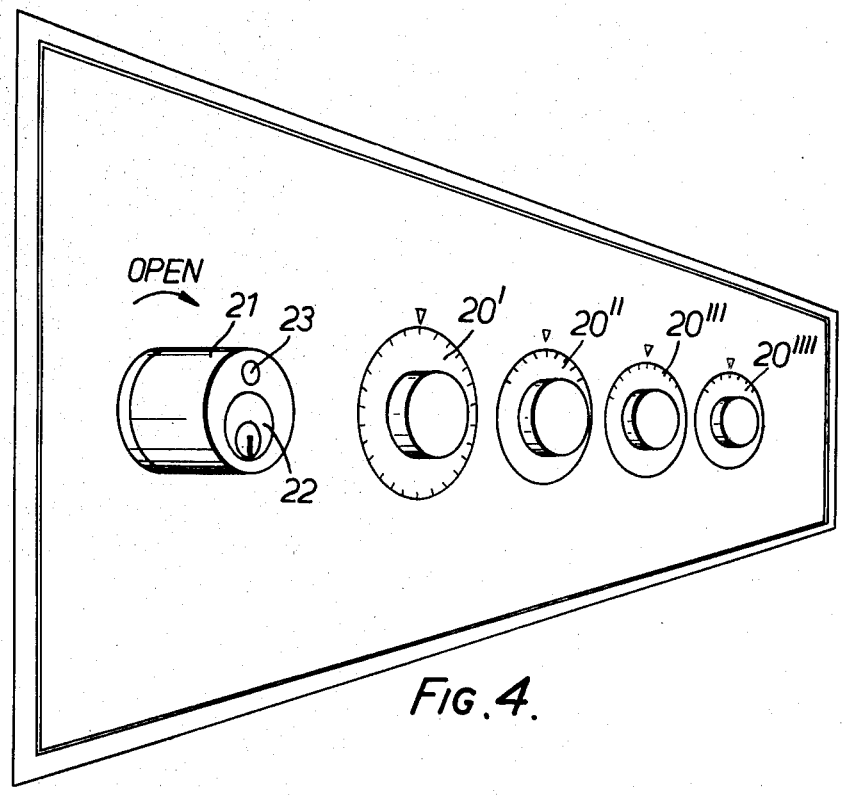
FIG. 4 is a perspective view of a face of a safe of the invention.

Referring now to FIG. 4, a safe is shown containing one set of four combination setting dials 20', 20'', 20''' and 20''''. The letters A to Z have been omitted from the face of these dials. However, these letters would be marked against the angle markings round the outer edge of each dial face.

Figure 5:
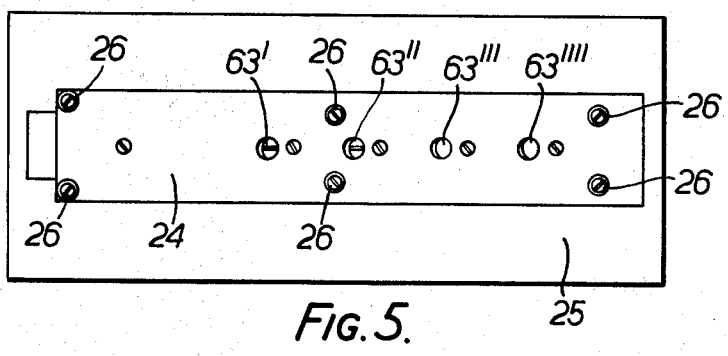
FIG. 5 shows the inside face of the safe lid.

An operating handle 21 contains a simple key lock 22 and a push button 23, shown in FIG. 4 with its end flush with the top face of the handle 21. The handle 21, lock 22 and push button 23 co-operate with a lock mechanism 24 (FIG. 5), which is a sub-assembly attached to the rear face of a safe lid 25 by screws 26.

The key of the lock 22 can, after insertion, be turned through 90° to release the push button 23, but the key can only be removed when it has been turned back to the "locked" position once more. With the button 23 in the position shown, the handle 21 can only be rotated 90° in a clockwise direction. When the lock 22 is unlocked, the button 23 is released, and being spring loaded it pops out until it is approximately 5 mm proud of the handle upper surface. In this position the handle 21 can be turned 90° counter-clockwise. The lock 22 can be re-locked, and the key removed with the button 23 out. Thereafter, if the button 23 is pushed in it will latch back with its face flush with the top surface of handle 21.

Figure 6:
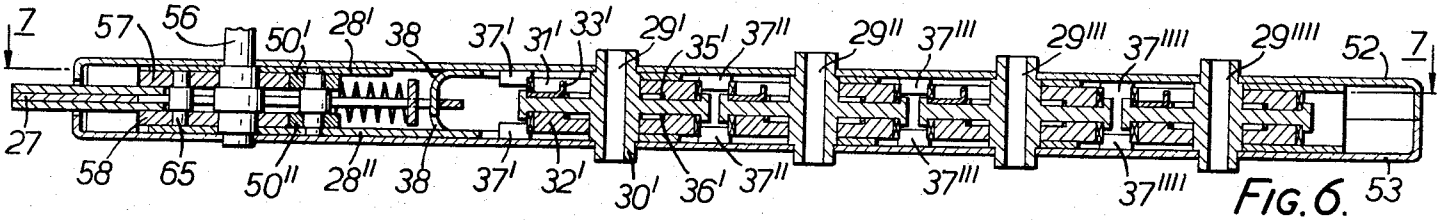
FIG. 6 is a cross section of the locking mechanism sub-assembly along its centre line.
Figure 7:
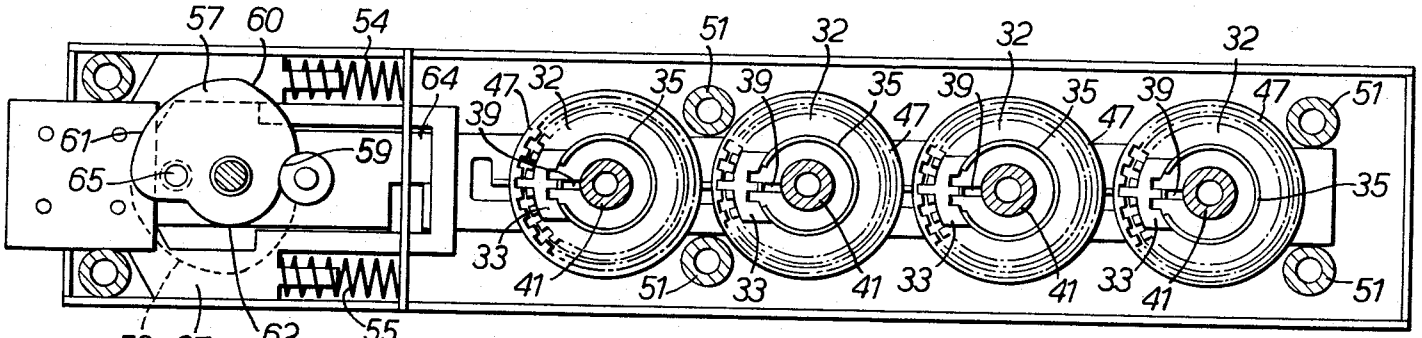
FIG. 7 is a view on top of the locking mechanism with parts removed to the level 7—7 of FIG. 6.

Referring now to FIGS. 6 and 7, the lock mechanism contains a bolt 27, two release slides 28' and 28'', and four gate assemblies 29', 29'', 29''' and 29''''.

Figure 8:
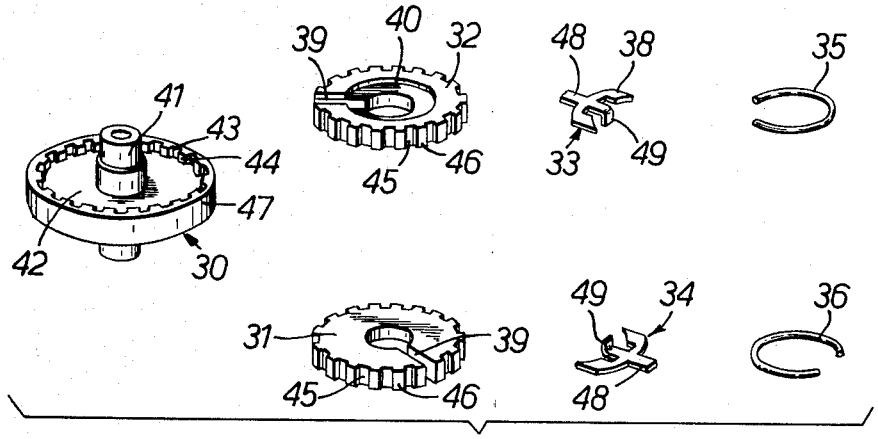
FIG. 8 is a perspective exploded view of the parts comprising one of the gate assemblies within the lock mechanism.

FIG. 8 shows each gate assembly 29', 29'', 29''' and 29'''' to be composed of a drive device 30, two coding discs 31 and 32, two coding lock tabs 33 and 34, and two springs 35 and 36. The relative positions of these are shown in FIGS. 6 and 7 for one assembly only. However, in the drawing, the lower coding lock tab 34 cannot be seen because its corresponding coding disc is not lying in the appropriate position.

The drive device 30 comprises a stem 41 and a disc 42. Extending from each side of the disc 42, around its outer surface, are rings 47 containing a number of internal, square shaped slots and teeth 43 and 44 respectively. The number of these slots 43 corresponds to the number of characters on the combination setting dials 20', 20'', 20''' and 20'''', in this case twenty six. The slots 43 on each side of the disc 42 are exactly aligned with each other axially. The coding discs 31 and 32 each contain a slot 39, a counterbored area 40 and a similar number of slots and teeth 45 and 46 respectively around their outer edge.

The items illustrated in FIG. 8 are assembled onto the drive device 30 with their counterbored surfaces inwards, and in each space so produced is trapped a coding lock tab 33 or 34 and a spring 35 or 36. Each coding lock tab has a tooth 48 and a bent tab 49. In the assembly, the springs 35 and 36 push their respective coding lock tabs 33 and 34 against the internal teeth each side of the drive device 30 and, at the same time, the bent tab 49 on each coding lock tab 33,34 rests within the slot 39 of its respective coding disc 31, 32. In this way the coding discs 31, 32 are locked within the drive device 30 and are unable to rotate relative to it. If however, either bent tab 49 is pushed radially towards the centre of the drive device 30, the coding disc 31, 32 with which it co-operates is released from the drive device 30, which may be freely rotated with respect to the former.

The combination setting dials 20', 20'', 20''', 20'''' are secured to each gate assembly 29', 29'', 29''' and 29'''' through holes in the safe lid 25 and by means of screws passing through each stem 41 centre hole. The combination setting dials are secured in position with their letters exactly aligned with the slots 43 on the drive device 30.

It can be seen that when the two coding lock tabs 33 and 34 on each assembly are sprung fully home, the slots 39 on each coding disc 31, 32 are held in a position relative to a letter on its associated dial. When any coding lock tab 33,34 is pushed towards the stem 41 of the drive device 30, its associated coding disc 31, 32 is freed and the position of its slot 39 may be altered to line up with a new dial letter.

Figure 9:
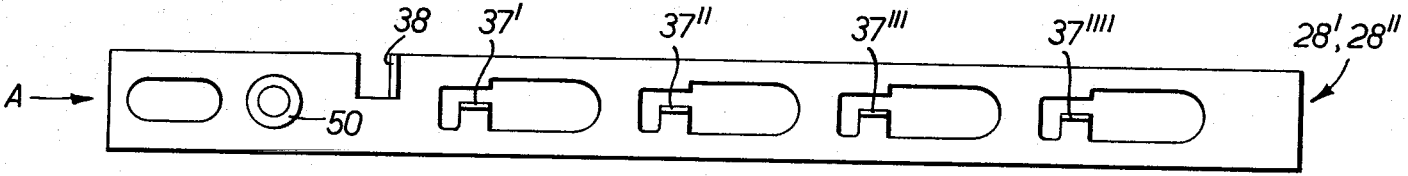
FIG. 9 is a plan view of a release slide within the lock mechanism.

Referring now to FIG. 9, there is shown the release slide 28' or 28''. This release slide 28' or 28'' contains four longitudinal tabs 37', 37'', 37''' and 37'''', and one transverse tab 38, all raised up in the same direction from the release slide face. The release slide also contains a roller 50 which has a case hardened peripheral surface. Release slides 28', 28'' are positioned each side of the gate assemblies, with their tabs facing inwards. These release slides 28', 28'' are able to move longitudinally within the lock mechanism and are guided by spacers 51, which also separate and secure lock mechanism covers 52 and 53.

It can be seen that the longitudinal tabs on the release slides 28', 28'' are normally resting in the spaces between the gate assemblies which are free to rotate. Should pressure in the direction of arrow A be applied to either release slide 28', 28'', it is prevented from moving far unless all the slots in its associated coding discs 31, 32 are aligned to permit the longitudinal tabs to enter them. In any other coding disc position, the release slide can do no more than slide into whichever of the teeth 45 are opposite the tabs 37, a movement of approximately 1 mm only. This small movement is sufficient to lock the coding discs 31, 32 in position without contacting their coding lock tabs 33, 34. The combination setting dials 20', 20'', 20''', 20'''' attached to each gate assembly 29', 29'', 29''', 29'''' are therefore locked in position. If however the combination setting dials 20', 20'', 20''', 20'''' have been rotated so that the slots 39 of the coding discs 31, 32 associated with either release slide 28', 28'' are all lined up with its tabs, pressure in the direction of arrow A will move that release slide into the slots 39. In so doing, the bent tabs 48, 49 on the coding locking tabs 33, 34 are contacted and moved radially towards the stems 41 of the drive devices 30, and each coding disc 31, 32 is released from the devices 30.

The coding discs 31, 32 are now held stationary by the tabs on the release slide but the drive device 30 can be turned by moving the combination setting dials 20', 20'', 20''', 20'''' on the outside of the safe lid 25. It is now possible to align another letter on each combination setting dial with each respective coding disc 31, 32 beneath, and these new relative settings become securely held when the release slide 28', 28'' is returned to its rest position once more. Indeed, they remain fixed when the combination setting dials are spun around on the outside of the safe lid 25.

Referring again to FIGS. 6 and 7, it can be seen that the transverse tabs 38 fit within a space 64 in the bolt 27, one from above and one from below. If either release slide 28', 28'' is moved in the direction of the arrow A it will take the bolt 27 with it. On release of the moving pressure, the return springs 54 and 55 return both the bolt 27 and the release slide 28', 28'' which was moved, back to their next positions.

Figure 10:
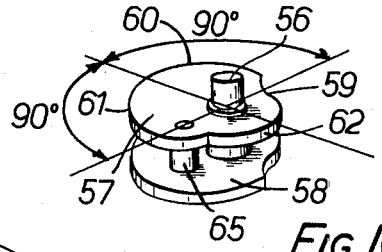
FIG. 10 is a perspective view of the cam within the lock mechanism used to release the bolt.

The handle 21 on the outside of the safe lid 25 is connected through a hole in the lid 25, by means of a stem 56 to two cams 57 and 58. The respective positions of these cams 57, 58 can be seen in FIG. 10. Each cam 57, 58 contains a semi-detent 59, approximately 2 mm deep, a lifting portion 60, rising approximately a further 8 mm, followed by a length 61 at constant radius. Each of these is disposed around 90° of the cam periphery. The remaining 180° approximately consists of a lower constant radius edge 62. The two cams 57, 58 are fixed onto the stem 56, in anti-phase, and they are displaced longitudinally so that they line up respectively with the rollers 50 on each release slide 28', 28''.

It can be seen that, assuming the release slides 28', 28'' are free to move, rotation of the handle 21 clockwise will cause one release slide to move, while the other remains stationary. Alternatively, rotation of the handle 21 counter-clockwise will reverse these respective release slide movements.

To place each release slide 28', 28'' in a free-to-move condition, it is necessary to rotate the combination setting dials until the slots 39 on their appropriate coding discs 31, 32 are correctly aligned. Once the release slide has moved fully, following 90° movement of the handle 21, it has disconnected all the coding discs 32 or 33 from the drive devices 30, enabling a new combination code to be set up on the combination setting dials. This new combination is fixed into the mechanism when the handle 21, and hence the release slide, is returned to its rest position. This handle rest position also corresponds to the locked position of the bolt 27, 90° handle movement in either direction corresponding to the unlocked position of this.

In order to ensure positive bolt movement into the locked position, a pin 65 is provided between the cams 57 and 58. This also dead locks the bolt 27 when the handle 21 is in the locked position.

It is clear that either of the two dial combinations can be altered when the bolt 27 is unlocked, the release slide 28', 28'' affected being dependant on whether the handle 21 has been turned clockwise or counter-clockwise. Also, the dial combinations suitable for each release slide are different. It is therefore possible for one combination to be used by a hotel customer, and the other by the hotel management.

In use, the hotel customer sees the safe in the condition shown in FIG. 4. When the hotel customer receives the safe unlocked, he can select any dial combination he may wish, set this up, and then lock the safe by turning the handle 21 counter-clockwise. The selected combination is now fixed in and the hotel customer may spin the dials to disrupt it. In this condition the safe can normally only be opened by re-selecting the customer's chosen combination, and the handle 21 can only be rotated clockwise to unlock.

Should the hotel management wish to open the safe, they may do so by selecting their own combination on the dials and unlocking the lock 22 to release the push button 23, thus enabling them to rotate the handle 21 counter-clockwise. This action moves the release slide not previously used by the customer.

Having unlocked the safe, it is possible for the hotel management to find and reset the customer's combination. To do this, the hotel management returns the handle 21 to the locked position, then by means of small windows 63', 63'', 63''', 63'''' (see FIG. 5) on the inside face of the lock mechanism, the hotel management are able to see the customer's half of the gate disc assembly and turn each dial until the appropriate coding disc slot 39 is seen to appear. The hotel management can then turn the handle 21 clockwise to unlock the safe, and leave it free for use by a new customer.

Figure 11:
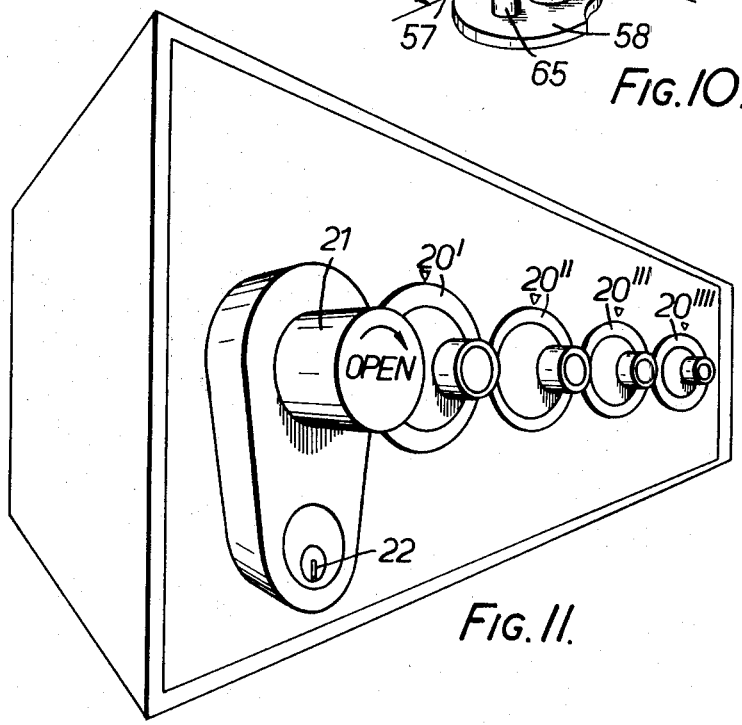
FIG. 11 is a perspective view of a safe of the invention having another face.

Referring now to FIG. 11, similar parts as in FIG. 4 have been given the same reference numeral and their construction and operation will not again be given in order to avoid undue length of description. In FIG. 11, the handle 21 is only permitted to turn clockwise unless the key is turned in the cylinder lock. This action frees the handle 21 to enable it to be turned counter-clockwise, following which the key may be returned to its central position and withdrawn. The handle rotation control automatically springs into position again when the handle 21 is returned to the central position. The clockwise and counter clockwise rotation of the handle 21 is enabled by connecting a stem or shaft of the handle 21 to appropriately shaped cam means like the cam means illustrated in FIG. 10. The remainder of the safe can be constructed and arranged to operate as described above in connection with FIGS. 5 to 10.

It is to be appreciated that the embodiments of the invention described above have been given by way of example only and that modifications may be effected. Thus, for example, the safe 1 can be constructed differently than is shown and can be floor or wall mounted and of box construction. Also, other applications are possible so that the safe 1 can be used, for example, in ships, hospitals and holiday homes. Numbers can be used instead of letters although letter combinations which can form a word should be easier to remember. Further, more or less than the four dials illustrated can be employed. Still, further, the first and second combination locking mechanisms can be entirely separate or they can share common parts, for example a common bolt and set of tumblers as in the case of the safe 1 shown in FIG. 1. With a common bolt and set of tumblers, the tumblers are set in the bolt withdrawal position by either set of dials.

In FIGS. 1 to 4, the two sets of dials 9, 10, 11, 12 and 16, 17, 18, 19 may be arranged to operate release slides like the release slides 28' and 28'' illustrated in FIGS. 6 and 7. The two sets of dials 9, 10, 11, 12 and 16, 17, 18, 19 may also each have a gate assembly like the gate assemblies 29', 29'', 29''' and 29'''' shown in FIGS. 6 and 7.

I claim:

1. A safe comprising walls, a door and safe-locking means, the safe-locking means comprising a bolt member, a first release slide which is able to move longitudinally in the safe-locking means and which operates the bolt member by moving the bolt member to a withdrawn position in which the safe is unlocked, a second release slide which is able to move longitudinally in the safe-locking means and which operates the bolt member by moving the bolt member to a withdrawn position in which the safe is unlocked, at least one set of combination dial assemblies, and a gate assembly for each combination dial assembly, the gate assemblies being such that they prevent the first and second release slides from moving longitudinally to operate the bolt member until either of first and second combination codes set in the safe-locking means are correctly dialed, the first combination code enabling the first release slide to move longitudinally and operate the bolt member, the second combination code enabling the second release slide to move longitudinally and operate the bolt member, and means for longitudinally moving one of said first and said second release slides when a corresponding one of said first and said second combination codes is correctly dialed.

2. A safe comprising walls, a door and safe-locking means, the safe-locking means comprising a bolt member, a first release slide which is able to move longitudinally in the safe-locking means and which operates the bolt member by moving the bolt member to a withdrawn position in which the safe is unlocked, a second release slide which is able to move longitudinally in the safe-locking means and which operates the bolt member by moving the bolt member to a withdrawn position in which the safe is unlocked, at least one set of combination dial assemblies, and a gate assembly for each combination dial assembly, each gate assembly having first and second parts with the first parts of all the gate assemblies forming a first set of gates for preventing the longitudinal movement of the first release slide until a first combination code has been dialed, with all the second parts of all the gate assemblies forming a second set of gates for preventing the longitudinal movement of the second release slide until a second combination code has been dialed, and means for longitudinally moving one of said first and said second release slides when a corresponding one of said first and said second combination codes is correctly dialed.

3. A safe according to claim 1 or claim 2 in which each gate assembly comprises a drive device having a pair of oppositely facing recesses, a ring of teeth positioned around the periphery of each recess, a toothed coding disc in each recess, and a coding lock tab for fitting in a slot in each coding disc and for controlling relative movement between the drive device and its associated combination dial.

4. A safe according to claim 3 including a spring housed in a recess in each coding disc and operative to push the lock tabs against the teeth of the drive device for locking the coding discs to the drive device until such time as the lock tabs move radially inwardly to their slots in the coding discs.

5. A safe according to claim 3 in which the release slides each have a first tab for fitting in a recess in the bolt member, and a plurality of second tabs which are equal in number to the number of combination dials and which normally rest between the gate assemblies.

6. A safe according to claim 1 or claim 2 in which the safe-locking means is such that the gate assemblies for the first combination code can be seen when the safe has been opened by correctly dialing the second combination code in order to enable the first combination code to be dialed.

7. A safe according to claim 6 in which the codes in the said at least one set of combination dials are letter codes.

8. A safe according to claim 2 in which said means for moving includes a handle for the safe provided with a stem which is fixed to a pair of cams, one cam being effective to longitudinally move the first release slide when the first combination code has been correctly dialed, and the other cam being effective to longitudinally move the second release slide when the second combination code has been correctly dialed.

9. A safe according to claim 1, 2 or 8 in which the walls of the safe are designed to slope away from the walls of a room when the safe is in position between two vertical walls of the room which are at right angles to each other.

10. A safe according to claim 4 in which the release slides each have a first tab for fitting in a recess in the bolt member, and a plurality of second tabs which are equal in number to the number of combination dials and which normally rest between the gate assemblies.

* * * * *